United States Patent [19]

Kalina

[11] 4,397,612

[45] Aug. 9, 1983

[54] GAS LIFT UTILIZING A LIQUEFIABLE GAS INTRODUCED INTO A WELL

[76] Inventor: Alexander I. Kalina, 12439 Millbanks, Houston, Tex. 77031

[21] Appl. No.: 214,979

[22] Filed: Dec. 10, 1980

Related U.S. Application Data

[63] Continuation-in-part of Ser. No. 13,893, Feb. 22, 1979, abandoned.

[51] Int. Cl.[3] ..... F04F 1/20

[52] U.S. Cl. ..... 417/54; 417/108; 417/109

[58] Field of Search ..... 417/54, 55, 108, 109, 417/207, 208, 110–117; 166/267, 368

[56] References Cited

U.S. PATENT DOCUMENTS

| | | | |
|---|---|---|---|
| Re. 24,873 | 9/1960 | Lindauer . | |
| 1,102,152 | 6/1914 | Jones | 417/54 |
| 1,834,052 | 12/1931 | Dolson | 417/108 |
| 1,858,847 | 5/1932 | Young | 166/267 X |
| 2,245,216 | 6/1941 | Morse | 417/54 |
| 2,275,947 | 3/1942 | Courtney | 417/109 |
| 2,380,639 | 7/1945 | Eris | 417/55 |
| 2,875,833 | 3/1959 | Martin . | |
| 4,079,590 | 4/1975 | Scheinbaum | 166/267 X |
| 4,224,992 | 9/1980 | Comberiati et al. | 166/273 |

FOREIGN PATENT DOCUMENTS

| | | |
|---|---|---|
| 2380448 | 9/1978 | France . |
| 939948 | 10/1963 | United Kingdom . |
| 1552309 | 9/1979 | United Kingdom . |
| 73499 | of 1970 | U.S.S.R. . |
| 349788 | 9/1972 | U.S.S.R. . |

OTHER PUBLICATIONS

New Methods of Fluid Lift by Liquified Gases and Solid Working Agents–Vniioeng, 1972, pp. 2–4.

*Primary Examiner*—Richard E. Gluck
*Attorney, Agent, or Firm*—Arnold, White & Durkee

[57] ABSTRACT

A gas lift method for lifting a well fluid from a well, the method comprising feeding a liquid lifting medium into a first well conduit of the well to maintain a liquid column of liquid lifting medium in the first well conduit to provide a significant liquid column pressure at the downhole region of the well for lifting medium to pass into a second well conduit to mix with well fluid therein and cause lifting of well fluid in the second well conduit.

20 Claims, 4 Drawing Figures

GAS LIFT UTILIZING A LIQUEFIABLE GAS INTRODUCED INTO A WELL

CROSS REFERENCE TO RELATED APPLICATION

Figure 1:
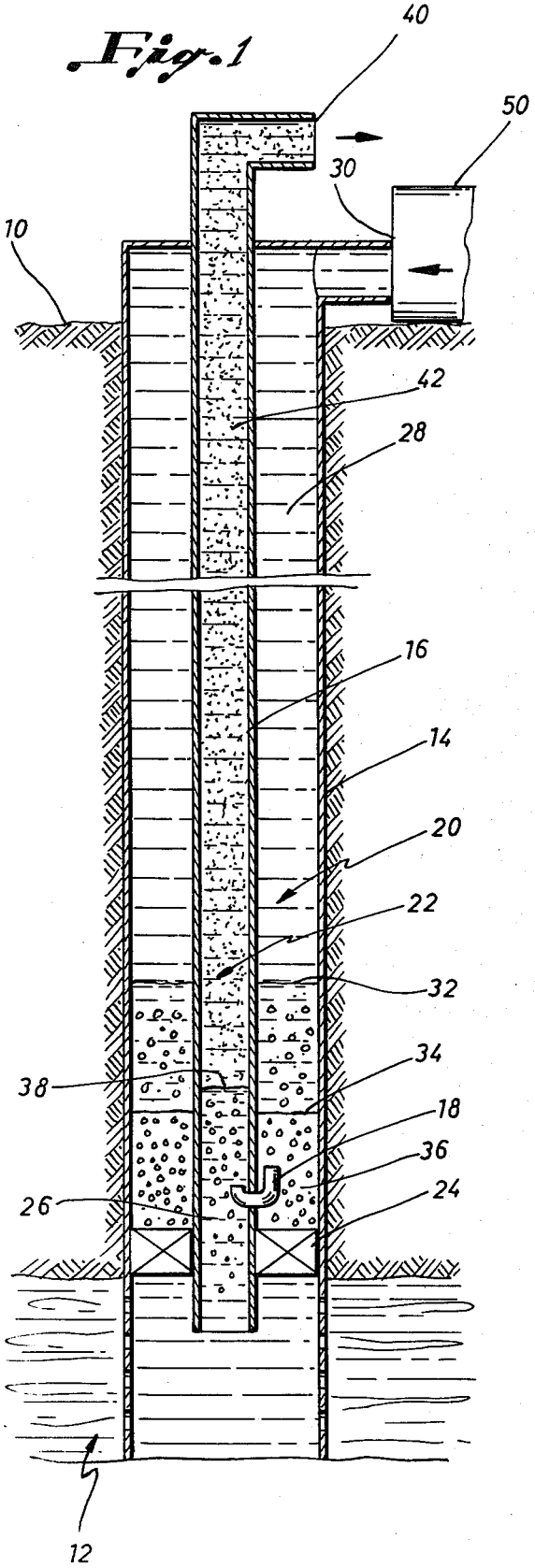

This application is a continuation-in-part application of my co-pending application Ser. No. 13,893 filed Feb. 22, 1979, now abandoned.

This invention relates to gas lift. More particularly, this invention relates to a gas lift method for lifting a well fluid from a well.

The concept of utilizing gas as a means of artificial lift of well fluids evolved in the late 1700s. The early methods were designed primarily for continuous flow operations. Continuous flow gas lift has been defined as a means of artificial lift where gas is continuously injected from the surface down the annulus defined between the tubing and casing of a well, through a gas lift valve between the annulus and the tubing, and up in the tubing string. The gas mixes with and aerates the fluids in the tubing string thereby providing a lifting force for lifting the fluids to the surface. Gas was traditionally injected either around the bottom or through a piece of equipment commonly called a foot piece.

A technology developed which provided for the selective injection of gas into the tubing string through gas lift valves which are well-known in the art. Intermittent gas lift is a means of artificial lift where a slug or column of liquid is allowed to accumulate in the tubing string, whereupon gases are injected through a gas lift valve underneath the liquid slug to propel it to the surface in the form of a plug. A wide variety of gas lift valves have been designed specifically for intermittent lift.

With both continuous and intermittent gas lift, it is required that substantial volumes of gas at substantial pressures be produced at the surface of the well to achieve desired results. In addition, numerous valves are required in known systems to provide suitable pressures at the points where gas is introduced into the tubing string. Because substantial pressures must be produced at the surface to force the substantial volumes of gas down the well for gas lift, the equipment in the form of compressors, tanks, conduits, valves and like which is required to handle the gas is substantial and expensive.

The high pressure components of the equipment require careful maintenance to avoid expensive or dangerous failures, and consume substantial quantities of energy.

Gas lift systems, because of the expense involved, are usually only employed in deep wells where well fluid recovery by pumping is impossible, impractical or uneconomical.

Thus, for example, in a well having a depth of say about 8,000 ft., substantial quantities of gas would have to be provided in the downhole region at a pressure typically in the order of about 120 atmospheres.

It follows that substantial quantities of gas therefore have to be compressed in a surface plant to pressures of approximately 115 atmospheres.

Apart from the expense of the equipment required to handle the gas and compress it to the pressures required, substantial amounts of energy are required for compressing the gas.

The energy so supplied for compressing the gas is lost during gas lift in that no significant energy recovery is possible.

It is accordingly an object of this invention to provide a gas lift method for lifting well fluids from wells, which substantially reduces or overcomes the disadvantages presented by the prior known methods.

It is accordingly a further object of this invention to provide a gas lift method which can have substantially lower energy requirements for providing a gas lift medium at a downhole location.

According to one aspect of the invention there is provided a gas lift method for lifting a well fluid from a well comprising first and second well conduits leading to a downhole region of the well, the conduits being in communication with each other in a downhole region and the second well conduit being in communication with well fluid in the well, the method comprising feeding a liquid lifting medium under pressure into the first well conduit to maintain a liquid column of liquid lifting medium in the first well conduit to provide a significant liquid column pressure at the downhole region of the first well conduit for lifting medium to pass into the second well conduit to mix with well fluid therein and cause lifting of well fluid in the second well conduit.

The efficiency and effectiveness of the method is related to the fact that a significant proportion of the pressure for gas lift is provided by the liquid column of lifting medium in the well.

The pressure in the downhole region of the first well conduit may be controlled by controlling the introduction pressure and the effective length of the liquid lifting medium column.

The effective length of the liquid lifting medium column may be controlled by controlling the level at which the upper level of the liquid column is maintained. This is conveniently done by controlling the rate at which liquid lifting medium is introduced into the first well conduit in relation to the rate at which lifting medium passes from the first well conduit into the second well conduit.

Alternatively, or additionally, the effective length of the liquid column may be controlled by controlling the level at which the lower level of the liquid column is maintained in the first well conduit.

Where the pressure provided by the hydrostatic head of the liquid lifting medium column in the first well conduit requires adjustment, or requires supplementation, the pressure in the downhole region may be controlled by controlling the introduction pressure at which the liquid lifting medium is introduced into the first well conduit.

For most applications of the invention, the introduction pressure of the liquid lifting medium will generally be expected to be larger than the hydrostatic pressure provided by the liquid lifting medium column.

Applicant believes that for very deep wells the supplementation pressure provided by the introduction pressure of the liquid lifting medium will generally comprise less than the pressure provided by the length of the liquid lifting medium column. The introduction pressure should, for shallower wells, make a greater contribution to the pressure required for gas lift.

The liquid lifting medium may be selected or formed so that it has an appropriate boiling temperature range for conditions prevailing in a well where the method is to be employed and for the particular way in which the method is to be carried out.

Depending upon these factors, therefore, the liquid lifting medium may be a single homogeneous substance, or may be a mixture of substances mixed in proportions to provide an appropriate boiling temperature range for the liquid lifting medium.

In one embodiment of the invention, the liquid lifting medium may be such, or the composition of the liquid lifting medium may be controlled in relation to the temperatures prevailing in the first well conduit of a well where the method of this invention is to be applied, that the lifting medium will be heated above its critical temperature in a downhole vaporization region of the first well conduit for complete or substantially complete vaporization to occur below the liquid column in the first well conduit.

In this example of the invention, since complete vaporization will occur in the first well conduit, only vaporized or gaseous liquid lifting medium will pass from the first well conduit into the second well conduit to mix with well fluid in the conduit.

In an alternative embodiment of the method of this invention, the liquid lifting medium may have a boiling temperature range such that vaporization will commence in a downhole vaporization region of the first well conduit in view of the temperatures and pressures prevailing therein.

Thus, for example, the boiling temperature range may be such that substantially complete vaporization will occur in the first well conduit, and that substantially only lifting medium vapor or gas will pass into the second well conduit to mix with well fluid therein and cause lifting of well fluid.

In an alternative example, the boiling temperature range may be such that incomplete vaporization will occur in the first well conduit, and that a mixture of liquid and gaseous working medium will therefore pass into the second well conduit for mixing with well fluid and causing lifting of well fluid.

In a further alternative example of the invention, the boiling temperature range of the liquid lifting medium may be such in relation to the temperatures and pressures prevailing in the well, and the liquid pressure in the first well conduit may be maintained so that vaporization of lifting medium will occur only or substantially only in the second well conduit.

Where the well fluid to be recovered is a hydrocarbon material such as oil, gas lift may occur as a result of vaporized lifting medium mixing with the oil, as a result of vaporized and/or unvaporized lifting medium mixing with the oil and causing vaporization of hydrocarbon components of the oil, or as a result of a combination of these factors.

Applicant believes, however, that depending upon the nature of the oil being recovered, the efficiency of the method of this invention will be related to the degree of vaporization of the lifting medium and/or to the degree of vaporization of components of the oil caused by lifting medium mixing with the oil.

The lifting medium may therefore, preferably, be selected or prepared so that complete or substantially complete vaporization will occur in a downhole region of the well.

Thus, for example, the liquid lifting medium may be selected or prepared so that vapor generated by vaporization of the lifting medium and/or by the lifting medium mixing with the oil will approach, will substantially approach, or will be equivalent to the quantity of vapor which would be generated by complete vaporization of the liquid lifting medium.

In addition, for improving the effectiveness of gas lift, the liquid lifting medium may be selected or prepared so that substantial vapor generation will occur before the mixture of lifting medium and well fluid reaches about the half-way zone in the height of the second well conduit, and preferably before the mixture reaches higher than the lower 10 to 20% of the height of the second well conduit.

In one preferred embodiment of the invention, the liquid lifting medium may be fed into the first well conduit to maintain a liquid which extends downwardly in the first well conduit from the surface. The liquid column will therefore extend downwardly to the vaporization zone, or, where vaporization only occurs in the second well conduit, the liquid column will extend down to the bottom of the first well conduit.

For maximum practical efficiency of the method of this invention, the liquid lifting medium introduced into the first well conduit should preferably comprise only liquid thereby permitting effective introduction of the lifting medium into the well, permitting the maintenance of an effective liquid column, and avoiding gas build-up in the first well conduit from interfering with operation of the method.

In practice, however, depending upon the cost and availability of components for forming the liquid lifting medium, a minor proportion of undissolved gas may be included in the liquid lifting medium.

Where the liquid lifting medium is introduced into the well conduit and contains a minor proportion of gas, the proportion of gas should, however, be sufficiently low to insure that the undissolved gas remains substantially entrained in the liquid lifting medium moving down the first well conduit, that it does not result in stalling of the downflow of liquid lifting medium, does not otherwise interfere with the downflow of liquid lifting medium, does not give rise to any significant counterflow tendency of undissolved gas in the first well conduit, and/or does not separate out to interfere in the first well conduit with the further introduction of liquid lifting medium and with the maintenance of the appropriate pressure by a liquid lifting medium column in the first well conduit.

Applicant believes therefore that any gas which is contained in or introduced with the liquid lifting medium should comprise such a minor proportion that the proportion of gas comprises less than about one percent, and preferably less than about one-half percent by weight of the liquid lifting medium, or less than about one to five percent by volume of the liquid lifting medium.

The lifting medium may be any appropriate medium which is conveniently available and which can present the required boiling or vaporization temperature range.

It follows that the lifting medium should preferably be a medium which will not contaminate the well fluid produced from the well, which can readily be recovered from the produced well fluid, and which can then be liquified by compression and/or cooling for reuse.

The lifting medium may therefore comprise a hydrocarbon medium or an inorganic medium of any suitable type.

Where the lifting medium is hydrocarbon medium, it may conveniently comprise a homogeneous mixture of hydrocarbons, such as, for example, a homogeneous mixture of $C_2$ and higher hydrocarbons.

An appropriate lifting medium mixture may be prepared from appropriate phase diagrams in a manner known to those skilled in the art, to provide a boiling or vaporization temperature range appropriate for the geothermal gradient of the well and for the pressures prevailing in the well.

Under certain conditions, well temperatures and pressures may be such that a single hydrocarbon medium, such as for example, propane or butane will provide an appropriate vaporization or boiling point for effective use alone as the lifting medium.

The lifting medium recovered from the well together with the well fluid, may be separated from the well fluid and may be liquified for reuse by any method known to those of ordinary skill in this art.

The invention further extends to a gas lift method comprising liquifying a gaseous lifting medium which is gaseous at ambient (standard) temperature and at a pressure above atmospheric pressure by compressing the lifting medium, introducing the liquified lifting medium into an interior zone of a well having a temperature above the vaporization temperature of the liquified lifting medium, maintaining a sufficient column of liquid lifting medium in the well to provide a substantial proportion of the pressure required for gas lift, and allowing vaporization to occur in the interior zone to lift well fluid from the well.

In accordance with a further aspect of the invention, there is provided a gas lift method for lifting a well fluid from a well, the method comprising introducing as the sole lifting medium for lifting the well fluid, a lifting medium consisting essentially of a liquid into the well, the lifting medium having a boiling range in relation to the temperature gradient prevailing between the surface and a downhole region of the well for the lifting medium to remain in liquid form during introduction into the well, and to vaporize substantially in the downhole region of the well, and allowing the lifting medium to mix with well fluid and to vaporize in the well to lift the well fluid from the well.

While the method of this invention may be used for the lifting of various types of well fluids, it has particular application in regard to the lifting of hydrocarbon materials from wells.

In an alternative example of the invention, to assist in controlling or limiting the pressure maintained in the first well conduit, an adjustable packer with a throttle valve may be provided in the first well conduit. The position of the packer as also the cross-sectional area of the throttle valve may be adjustable in accordance with conventional techniques.

Embodiments of the invention are now described by way of example with reference to the accompanying drawings.

In the drawings, FIGS. 1–4 show alternative embodiments of the method in accordance with this invention, with each Figure showing a fragmentary sectional side elevation through a well leading from the surface to a subsurface oil bearing formation containing oil to be recovered by the method of this invention.

In each of FIGS. 1–4, reference numeral 10 indicates the earth's surface, reference numeral 12 indicates the hydrocarbon material bearing formation, reference numeral 14 indicates the well casing of a well extending from the surface 10 to the formation 12, reference numeral 16 indicates the tubing string located within the casing 14, reference numeral 18 indicates a gas lift valve leading from the annulus 20 defined between the casing 14 and the tubing string 16 to the interior 22 of the tubing string 16, and reference numeral 24 indicates a packer.

Figure 2:
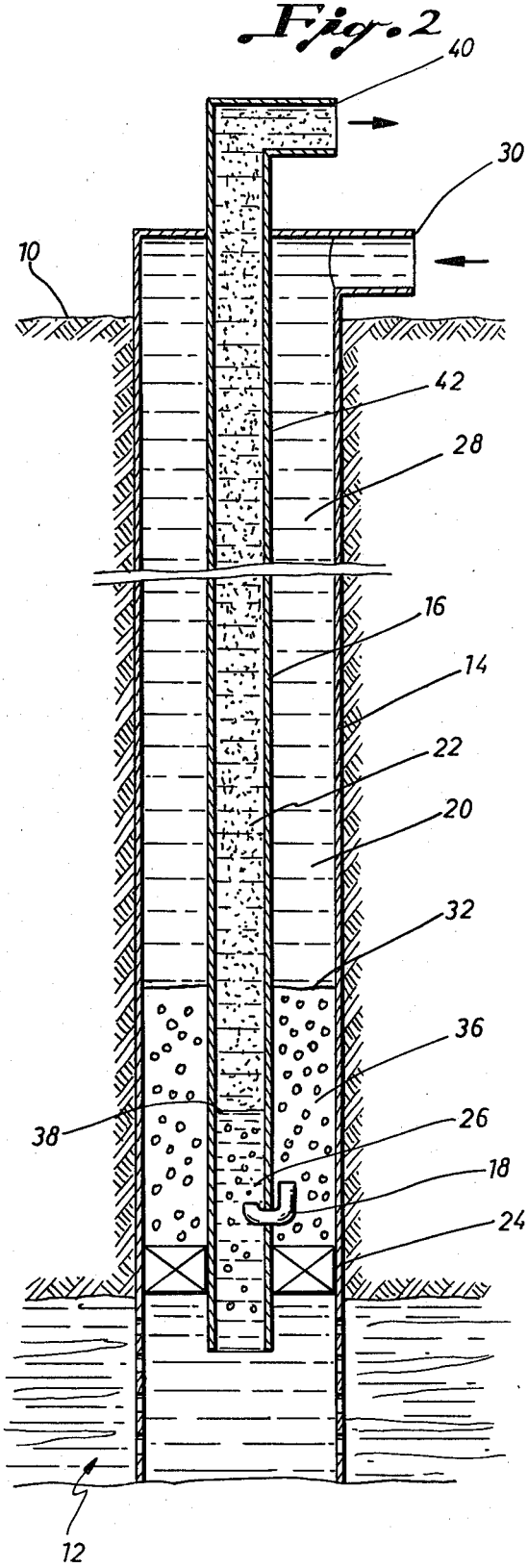
Figure 3:
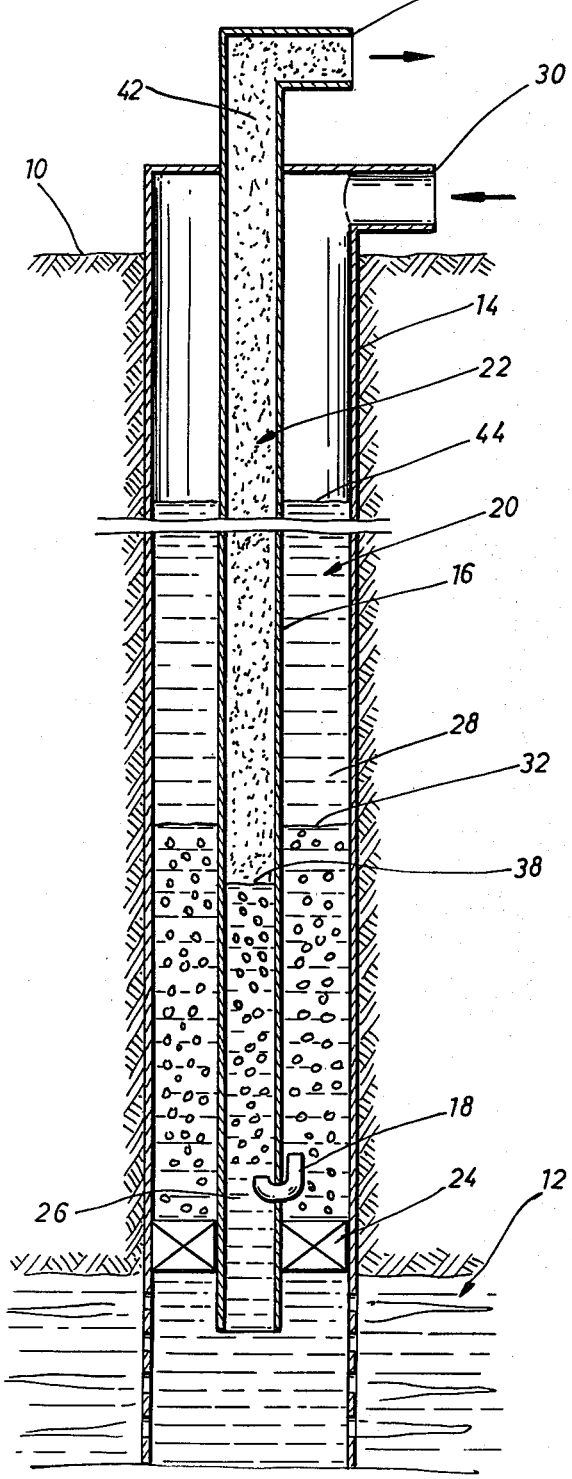
Figure 4:
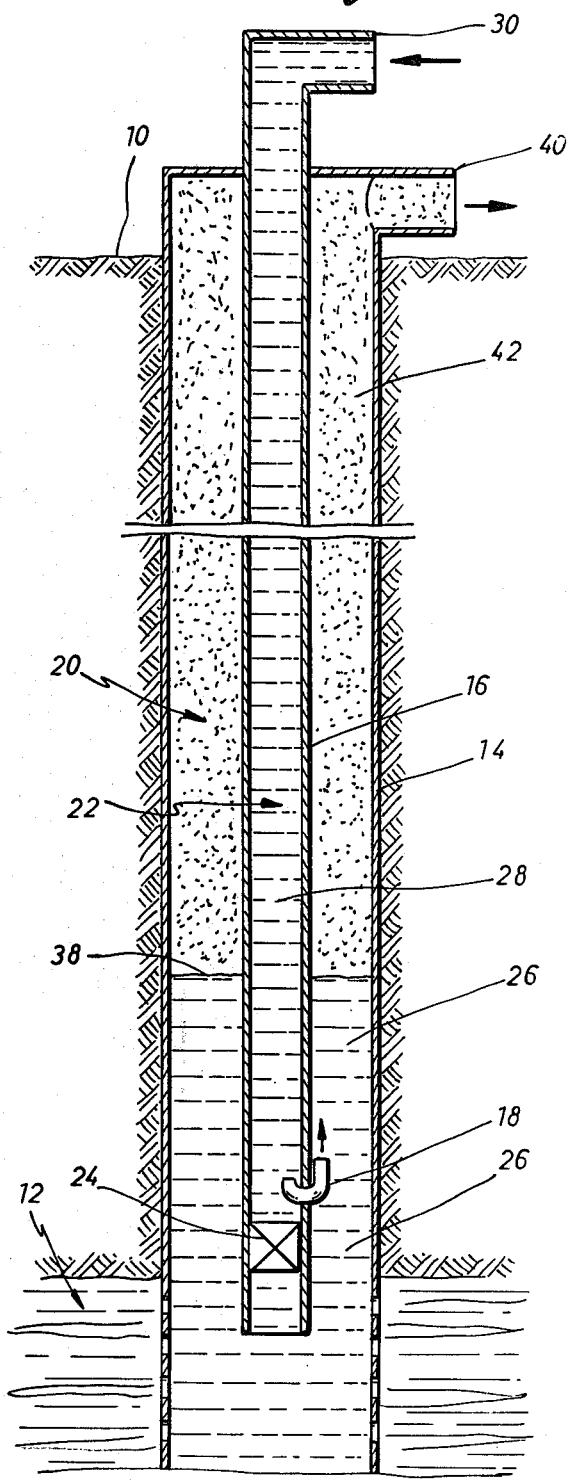

In FIGS. 1–3 of the drawings, the annulus 20 constitutes the first well conduit whereas the interior 22 of the tubing string 16 constitutes the second well conduit. In FIG. 4, however, the interior 22 constitutes the first well conduit and the annulus 20 constitutes the second well conduit.

In each Figure of the drawings, the first well conduit 20 or 22, as the case may be, is separated from the well fluid 26 in the formation 12 by the packer 24. In each case, the gas lift valve 18 extends between the annulus 20 and the interior 22 in a lower downhole region of the well.

The gas lift valve 18 may be of any conventional type and may, if desired, be adjustable by means of a wire (not shown) extending to the surface from the valve 18.

It will be appreciated that one valve 18 has been shown in each drawing for convenience only. It will be understood that a plurality of valves 18 may be provided at circumferentially spaced zones and/or at vertically spaced zones, as required. It will further be understood that in place of the gas lift valve 18, a hole in the tubing may for example be employed. In each figure of the drawings, the liquid lifting medium employed is a hydrocarbon material mixture comprising hydrocarbon material constituents which are mixed in appropriate proportions to provide suitable boiling temperature or boiling temperature ranges for the temperatures and pressures prevailing in the wells and for the particular method employed in carrying out the invention.

The particular hydrocarbon materials may be selected from, for example, ethane, propane, butane and higher (i.e. heavier) hydrocarbons. The lifting medium may be prepared with the aid of standard phase diagrams in a manner known to those skilled in the art.

By using a lifting medium of hydrocarbon material, the lifting medium can be recovered from the oil produced in the wells and can be reused. In addition, of course, constituents for the lifting medium can be recovered from the oil produced from the wells.

In FIG. 1 of the drawings, the lifting medium in liquid form under sufficient pressure to be overcooled and thus remain in liquid form, is introduced continuously into the annulus 20 to maintain a liquid column which extends downwardly from the introduction zone 30 of the casing or first well conduit 14 down to a vaporization zone 32.

The lifting medium 28 has no gas entrained therein and is pumped into the annulus 20 under sufficient pressure to maintain the lifting medium in liquid form. The lifting medium may be pumped in by means of, for example, pump means 50 as shown in FIG. 1.

The boiling temperature range of the lifting medium 28 is such that it is expected to commence vaporization in the vaporization zone 32 near the bottom of the well once the temperature of the lifting medium 28 has been raised above its boiling temperature range by the geothermal temperature prevailing in the well.

The lifting medium 28 should continue to vaporize until it reaches a second zone 34 in the annulus 20 where it should have evaporated completely.

The column of lifting medium 28 in the annulus 20 provides with the introduction pressure, sufficient pressure at the lower end of the liquid column in the region of the vaporization zone 32 to cause the lifting medium vapor 36 to flow through the gas lift valve 18 and mix with the well fluid or oil 26 in the interior 22 for providing gas lift.

As is conventional, the arrangement is such that the pressure in the formation 12 maintains the level of oil 26 at a point 38 above the gas lift valve 18.

The lifting medium vapor 36 mixes with the oil 26 in the interior 22 thereby reducing its specific gravity and providing a lifting force for the oil/lifting medium vapor to lift up the interior 22 of the tubing string 20 to the outlet zone 40 of the tubing string 16.

The pressure of the lifting medium 28 is controlled so that the oil/lifting medium vapor emerges from the outlet zone 40 at a pressure above ambient pressure thereby facilitating recovery thereof.

The oil/lifting medium vapor 42 emerging from the outlet zone 40 can be treated by conventional means to separate the lifting medium vapor 36 from the oil 26, to condense the lifting medium vapor 36 by applying pressure and/or cooling, and then to resupply the liquified lifting medium to the introduction zone 30.

In the embodiment illustrated in FIG. 2 of the drawings the lifting medium composition is such that it provides a boiling range such that the liquid lifting medium 28 will be heated above its critical temperature in the annulus 20 when it reaches the vaporization zone 32.

At that point, the liquid lifting medium 28 would be expected to vaporize completely to provide lifting medium vapor 36 in the lower downhole region of the annulus 20.

Thereafter the method of FIG. 2 operates in the same way as the method of FIG. 1 in that the vapor 36 mixes with the oil or well fluid 26 and raises it up the tubing string 16 to the outlet zone 40.

In FIG. 3 of the drawings, the liquid lifting medium 28 is again fed into the annulus 20 through the introduction zone 30.

In this embodiment of the method of this invention, however, the liquid lifting medium has a boiling range in relation to the pressure prevailing in the lower region of the annulus 20 and the temperature prevailing in the well, that the heating of the liquid lifting medium in the well will not be sufficient to cause complete vaporization of the liquid lifting medium in the annulus 20.

The liquid lifting medium should therefore commence vaporization in the vaporization zone 32 and should continue to evaporate lower down in the annulus 20, resulting in a mixture of lifting medium in liquid and in gaseous form passing into the interior 22 through the gas lift valve 18 to mix with well fluid 26 in the interior 22.

In the embodiment of FIG. 3, because of well conditions, the height of the liquid column 28 is limited to provide the appropraite pressure in the downhole region. The feed of liquid lifting medium 28 is therefore controlled to maintain the upper level 44 of the liquid column at an appropriate level for the required pressure.

The pressure in the liquid column 28 forces the liquid lifting medium through the gas lift valve 18 into the interior 22.

In the embodiment shown in FIG. 4 of the drawings, the process is generally similar except that the liquid lifting medium 28 is introduced into the interior 22 of the tubing string 16 so that it thereby constitutes the first well conduit.

However, the embodiment of FIG. 4 differs from the prior embodiments in that a complete column of liquid lifting medium is maintained in the tubing string 16 resting on the packer 24.

In the embodiment of the method illustrated in FIG. 4, the lifting medium 28 has a boiling temperature range, and the pressure provided by the liquid column 28 is such in relation to the temperature prevailing in the well that no or substantially no vaporization of the lifting medium 28 occurs in the interior 22.

The pressure provided by the liquid lifting medium column 28 therefore forces the lifting medium in liquid or substantially in liquid form through the gas valve 18 to mix with the well fluid 26.

While in admixture with the well fluid 26, the liquid lifting medium will vaporize and/or will cause vaporization of the well fluid 26 to produce gas or vapor for lifting the well fluid to the surface.

The embodiments of the invention as illustrated with reference to the drawings, provide the particular advantages that a lifting medium is employed which is in liquid form, and which can thus be introduced into the well without the need for high pressure gas compression equipment.

The embodiments of the invention provide the further advantage that the boiling temperature range of the lifting medium can readily be controlled in accordance with conventional techniques in relation to the temperatures and pressures prevailing in a well to achieve effective vaporization in a desired region of the well to provide the most efficient gas lift conditions for a particular well.

The embodiments provide the further advantage that the vaporized lifting medium can be separated from the produced well fluid by using conventional low pressure separation equipment, can be liquified again by using conventional low pressure equipment, and is then available for reuse.

In carrying out the method of this invention, the liquid lifting medium column maintained in the first well conduit will provide a significant proportion of the downhole pressure required for gas lift.

Thus, for example, if the liquid lifting medium is in the form of a liquid mixture having properties similar to propane or the like, the lifting medium can be liquefied at ambient temperature by compressing it to about 13 atmospheres.

Liquefied lifting medium at a relatively low pressure of about 20 atmospheres can be pumped into an 8,000 ft. deep well to produce a liquid column which provides a downhole pressure of 120 atmospheres.

In other words, in comparison to an equivalent conventional gas lift system, the introduction energy consumed by the method of this invention to provide such a downhole pressure would be that required to compress the lifting medium to a pressure of 20 atmospheres as opposed to the energy required to compress a gas to a pressure of 115 atmospheres.

The method of this invention provides the further advantage that by utilizing a lifting medium in the form of a liquid which is maintained in a liquid column in the first downhole zone, the energy provided by the geothermal temperature gradient can be employed effectively to contribute to the energy required for gas lift.

It will readily be appreciated that by using a lifting medium in liquid form the volume of lifting medium passing through the first well conduit to provide a degree of vaporization for gas lift equivalent to that provided by forcing gas under pressure through the first well conduit, will be several times less than the volume of gas as is used in conventional gas systems.

For this reason the liquid lifting medium will flow several times more slowly through the first well conduit and will thus remain several times longer in the first well conduit.

It is apparent, therefore, that for this reason alone the liquid lifting medium column in the first well conduit is able to receive several times more heat than the gas in a conventional gas system, as a result of the geothermal gradient in a well.

In addition, as is well known, the heat transfer coefficient for a liquid in such a conduit would be many times greater than for a gas.

These factors together show that in the method of this invention the liquid lifting medium in the first well conduit would receive many times more heat than gas providing an equivalent gas lift would receive.

The heat so received by the liquid lifting medium provides heat for causing vaporization for gas lift.

The method of this invention therefore provides the substantial advantage that energy required for gas lift is provided by the geothermal gradient and by the pressure generated by a column of liquid lifting medium in the first well conduit.

What is claimed is:

1. A gas lift method for lifting a well fluid from a well comprising first and second well conduits leading to a downhole region of the well, the conduits being in communication with each other in a downhole region and the second well conduit being in communication with well fluid in the well, the method comprising feeding a liquid lifting medium under pressure into the first well conduit to maintain a liquid column of liquid lifting medium in the first well conduit to provide a significant liquid column pressure at the downhole region of the first well conduit for lifting medium to pass into the second well conduit, the composition of the liquid lifting medium being such in relation to the temperature prevailing in the first well conduit, that the lifting medium will be heated above its critical temperature in a downhole vaporization region of the first well conduit for the lifting medium to change into a gas phase below the liquid column in the first well conduit, and the lifting medium being miscible with the well fluid to mix with well fluid and cause vaporization for the lifting of well fluid in the second well conduit.

2. A method according to claim 1, in which the pressure in the downhole region of the first well conduit is controlled by controlling the effective length of the liquid column.

3. A method according to claim 2, in which the effective length of the liquid column is controlled by controlling the level at which the upper level of the liquid column is maintained.

4. A method according to claim 2 or claim 3, in which the effective length of the liquid column is controlled by controlling the level at which the lower level of the liquid column is maintained.

5. A method according to claim 1, claim 2 or claim 3, in which the pressure in the downhole region is controlled by controlling the introduction pressure at which the liquid lifting medium is introduced into the first well conduit for the introduction pressure to supplement the pressure provided by the liquid column.

6. A method according to claim 4, in which the level of the lower level is controlled by controlling the composition of the liquid lifting medium to provide a boiling temperature range such that the geothermal temperature in the well will cause the liquid lifting medium to be heated above its boiling temperature range at the required level in the first well conduit.

7. A method according to claim 4, in which the level of the lower level of the liquid column is controlled by controlling the composition of the working medium such that it will be heated above the critical temperature by the geothermal heat in the first conduit at the required level to thereby establish the lower level of the column.

8. A method according to claim 1, in which the lifting medium comprises a hydrocarbon medium.

9. A method according to claim 8, in which the lifting medium comprises a mixture of $C_2$ and higher hydrocarbons mixed in suitable proportions to provide a boiling temperature range for the lifting medium appropriate for pressure and temperature conditions prevailing in the well.

10. A method according to claim 1, in which the two well conduits are the annulus and tubing string of the well, and in which the first well conduit is separated from well fluid by a packer located therein.

11. A method according to claim 1, which comprises recovering well fluid and lifting medium produced in the second well conduit, separating the lifting medium from the well fluid, and condensing the lifting medium for re-use.

12. A gas lift method for lifting a well fluid from a well comprising first and second downhole zones, the downhole zones being in communication with each other in a downhole region and the second downhole zone being in communication with well fluid in the well, the method comprising:

(a) introducing a liquid working medium under pressure into the first downhole zone, the working medium comprising a liquefied gas and being miscible with the well fluid;

(b) maintaining a column of liquid working medium in the first downhole zone to provide a downhole pressure in the first downhole zone which is sufficient to cause working medium to flow from the first downhole zone into the second downhole zone to mix with well fluid and form a well fluid mixture; and (c) the working medium having a composition which is such in relation to the downhole zone that the working medium will be heated above its critical temperature in the first downhole zone for a gas phase working medium to be produced in the first downhole zone, and which has a composition such that when it is heated by downhole heat and mixes with the well fluid it forms a well fluid mixture which is capable of boiling at the downhole temperature and pressure in the second downhole zone for the well fluid mixture to lift from the well.

13. A method according to claim 12, in which the downhole pressure which is provided in the first downhole zone is controlled by controlling the effective length of the liquid column.

14. A method according to claim 13, in which the effective length of the liquid column is controlled by controlling the level at which the upper level of the liquid column is maintained.

15. A method according to claim 13 or claim 14, in which the effective length of the liquid column is controlled by controlling the level at which the lower level of the liquid column is maintained.

16. A method according to claim 12 or claim 13, in which the pressure in the downhole region is controlled by controlling the introduction pressure at which the liquid lifting medium is introduced into the first well conduit for the introduction pressure to supplement the pressure provided by the liquid column.

17. A method according to claim 15, in which the level of the lower level of the liquid column is controlled by controlling the composition of the working medium such that it has a boiling temperature range for the geothermal temperature in the well to heat the working medium above its boiling temperature range for boiling to commence in the first downhole zone at the required level and thereby establish the lower level of the liquid column.

18. A method according to claim 12, in which the working medium comprises a mixture of $C_2$ and higher hydrocarbons mixed in suitable proportions to provide a boiling temperature range for the lifting medium appropriate for pressure and temperature conditions prevailing in the well.

19. A method according to claim 12, in which the first and second downhole zones are provided by the annulus and tubing string of the well respectively, and in which the annulus is separated from well fluid below it by means of a packer.

20. A method according to claim 12, which comprises recovering the well fluid and working medium produced from the well, and liquefying the working medium for re-use.

* * * * *